US006025819A

United States Patent [19]

Xie et al.

[11] Patent Number: 6,025,819

[45] Date of Patent: Feb. 15, 2000

[54] METHOD FOR PROVIDING A GRAY SCALE IN A FIELD EMISSION DISPLAY

[75] Inventors: Chenggang Xie, Phoenix; Robert T. Smith, Tempe; Rodolfo Lucero, Scottsdale, all of Ariz.

[73] Assignee: Motorola, Inc., Schaumburg, Ill.

[21] Appl. No.: 08/943,174

[22] Filed: Oct. 3, 1997

[51] Int. Cl.[7] ..... G09G 3/22

[52] U.S. Cl. ..... 345/74; 345/148

[58] Field of Search ..... 345/74, 75, 77, 345/76, 147, 148, 208, 210, 55; 315/169.1, 169.3

[56] References Cited

U.S. PATENT DOCUMENTS 5,767,823 6/1998 Hush ..... 345/55
5,856,812 1/1999 Hush et al. ..... 345/77

*Primary Examiner*—Xiao Wu
*Attorney, Agent, or Firm*—Jasper W. Dockrey; Kevin D. Wills

[57] ABSTRACT

A method for providing a gray scale in a field emission display (50) includes the step of providing a first driving pulse (214) having a pulse width equal to a pulse width separation (115) between the graphs (100, 200) of total charge response versus pulse width of a driving pulse for the non-ideal field emission display and the corresponding ideal field emission display. The pulse width separation (115) is the horizontal distance between the two graphs (100, 200) at a region wherein the two graphs (100, 200) are generally parallel. The pulse width, $t_n$, of an nth driving pulse corresponding to an nth gray scale level is given by $t_n=t_1+[n-1]*[(t_N-t_1)/(N-1)]$, wherein $t_1$ is the pulse width of the first driving pulse (214), N is the total number of gray scale levels, and $t_N$ is the pulse width of the Nth driving pulse.

16 Claims, 3 Drawing Sheets

-PRIOR ART-

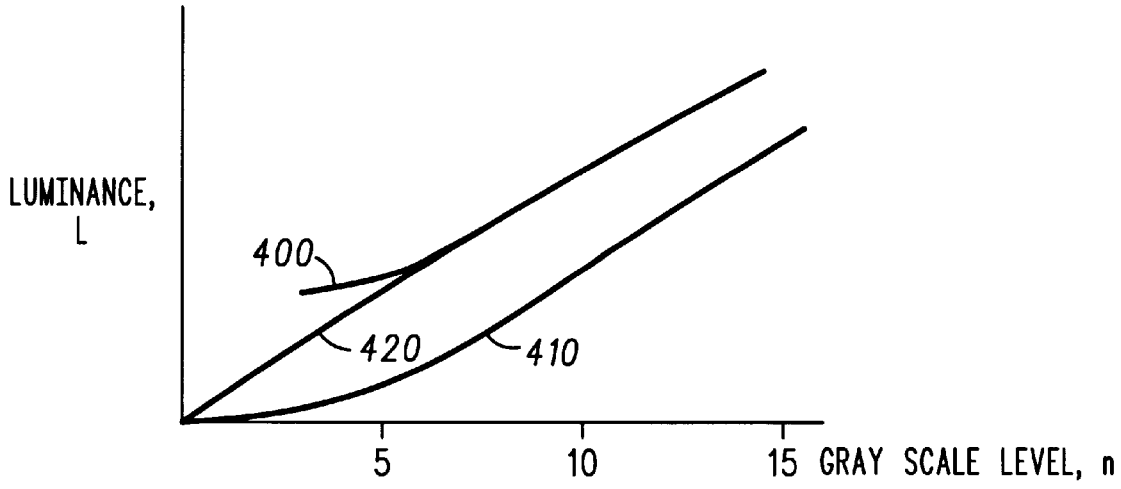
FIG. 5
FIG. 6
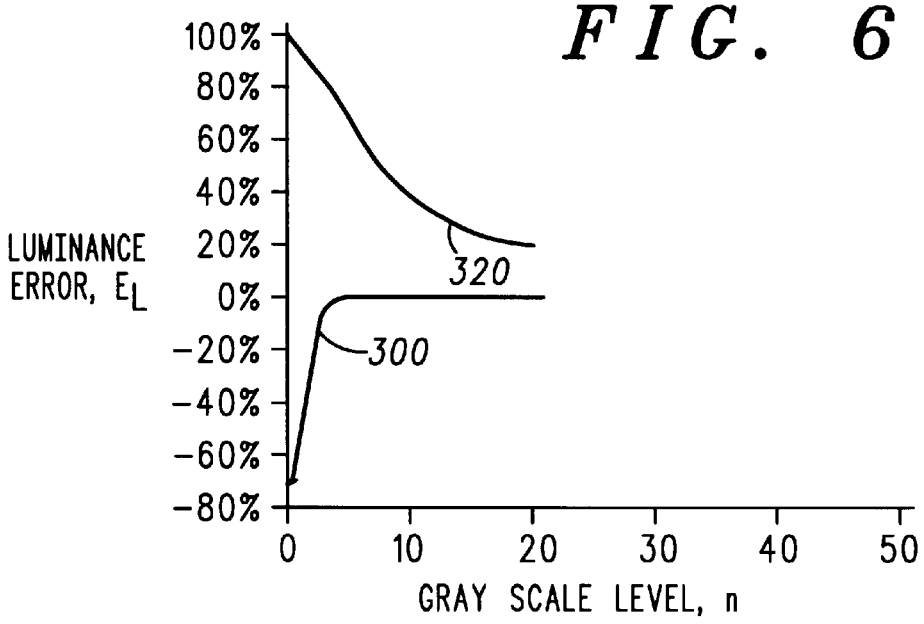

METHOD FOR PROVIDING A GRAY SCALE IN A FIELD EMISSION DISPLAY

FIELD OF THE INVENTION

The present invention pertains to the area of field emission displays and, more particularly, to methods for realizing a gray scale in field emission displays.

BACKGROUND OF THE INVENTION

It is known in the prior art to realize a gray scale in a display device by providing a drive voltage signal having an amplitude that is proportional to brightness. Although this analog modulation scheme has been used successfully with other display devices, it is not practical for use with field emission display devices. Due to the device characteristics of the field emission array, the uniformity of the electron emission typically degrades at lower emission currents and, equivalently, at lower drive voltages.

To alleviate this uniformity problem, field emission displays are driven with drive voltages having values that are high enough to ameliorate the uniformity problem. The gray scale levels are then realized by modulating the pulse width of the constant voltage drive signal, so that the pulse width is proportional to the gray scale level, n. The constant of proportionality is equal to a gray scale pulse increment. The gray scale pulse increment is calculated by first determining a maximum pulse width, which is the pulse width that corresponds to the maximum brightness of the display. The gray scale pulse increment is calculated by dividing the maximum pulse width by the desired number of gray scale levels.

For a typical field emission display, the maximum pulse width is about 35 $\mu$s. To achieve the 256 gray scale levels characteristic of a VGA display, the gray scale pulse increment is equal to 35 $\mu$s divided by 256, or 0.14 $\mu$s. This is a very short pulse. According to the above prior art scheme, the nth gray scale level is achieved by driving the display with a pulse having a pulse width equal to the gray scale pulse increment multiplied by n. For low n, the pulse width of the driving pulse can be within the pixel RC time constant of the display This causes the drive signal to be appreciably distorted when it reaches a pixel. Because of the significant signal distortions at low pulse widths, the brightness response with respect to the pulse width of the drive signal is non-linear at low pulse widths. This results in a brightness response that deviates appreciably from the brightness response of an ideal display that has a RC time constant equal to zero. The prior art has attempted to solve this problem by reducing the total number of gray scale levels. This compromises the quality of the display image.

Each electron emitter in a field emission display device can be modeled as a capacitor, and the interconnections, such as the ballast resistor, can be modeled as a resistance. Because these displays can be modeled as distributed resistive-capacitive networks, each addressed row and column has an intrinsic resistive-capacitive time constant. Driving one end of a row or column with a signal typically results in that signal becoming increasingly filtered as it travels across the display. The signal at a pixel along the given row or column will differ from the inputted drive signal. This detrimental effect is most pronounced at the lower end of the gray scale, wherein the drive pulses are shortest.

The RC time constant for a pixel of a field emission device can range from a few hundred nanoseconds to a few microseconds and is a function of device parameters, such as the resistance and capacitance per pixel. For example, for resistance per pixel and a capacitance per pixel of 1M Ω and 3 pF, respectively, the pixel RC time constant is 3 $\mu$s. Given a gray scale pulse increment of 0.14 $\mu$s, more: than 50% of the gray scale levels are affected by the resulting pulse distortion. While the pulse distortion car be improved by optimizing the display structure to lower the pixel RC time constant, even very low pixel RC time constants result in gray scale distortion at the first few levels.

Accordingly, there exists a need for an improved method for achieving a gray scale in a field emission display device, which provides a high number of gray scale levels.

BRIEF DESCRIPTION OF THE DRAWINGS

FIG. 5 includes graphical representations of luminance versus gray scale level; and FIG. 6 includes graphical representations of luminance error versus gray scale level for a method in accordance with the invention and for a prior art method.

Figure 1:
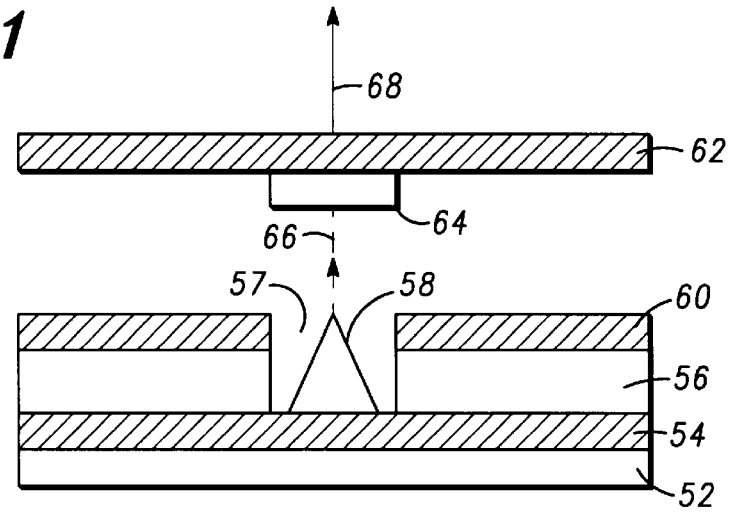
FIG. 1 is a cross-sectional view of a prior art field emission device for use with the method of the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION

The invention is for a method for providing a gray scale in a field emission display. The method of the invention provides a gray scale that substantially reduces luminance error over most of the gray scale levels. The method of the invention further allows a greater total number, N, of gray scale levels over prior art methods. The method of the invention includes the step of providing a first driving pulse corresponding to a first gray scale level (n=1), which has a pulse width that is greater than a pixel RC time constant of the field emission display In the preferred embodiment, the pulse width of the first driving pulse is equal to the pulse width separation between the graphs of total charge response versus pulse width of a driving pulse for the non-ideal (non-zero RC time constant) field emission display and the corresponding ideal (zero RC time constant) field emission display. The pulse width separation is the horizontal distance between the two graphs at a region wherein the graphs are generally parallel to one another.

FIG. 1 is a cross-sectional view of a prior art field emission display 50 for use with the method of the invention. Field emission display 50 includes a substrate 52, upon which is disposed a cathode 54, Cathode 54 includes a portion that is made from a material having a high resistivity. This portion is referred to as a ballast layer. The ballast layer is included to protect against catastrophic electrical arcing between cathode 54 and an anode 62. The ballast layer typically has a sheet resistance within a range of a few megaohms per square to several hundred megaohms per square. This resistance coupled with the capacitance of the device results in a pixel RC time constant that is within a range of a few hundred nanoseconds to a few microseconds.

Field emission display 50 further includes a dielectric layer 56, which is disposed upon cathode 54 and which defines an emitter well 57. An electron emitter 58 is disposed within emitter well 57. A gate extraction electrode 60 is disposed upon dielectric layer 56 proximate to electron emitter 58. A phosphor 64 opposes electron emitter 58 to collect a plurality of electrons 66 emitted therefrom. Phosphor 64 is disposed on anode 62, which is transparent. When electrons 66 are received by phosphor 64, a light emission 68 is generated therefrom. Light emission 68 traverses anode 62 and exits therefrom.

The brightness of light emission 68 depends, in part, upon the total number of electrons 66 emitted when a driving pulse is applied to cathode 54. The total number of electrons 66 in turn depends upon the pulse width of the driving pulse.

The pulse width of a driving pulse has; a maximum value, which depends upon the display resolution (number of scanned lines) and the frame rate. A frame is defined by the plurality of scanned lines. The frame rate is equal to the number of frames scanned per unit time. Typically, gate extraction electrodes 60 are the scanned lines. The maximum pulse width of a driving pulse is equal to the inverse of the product of the frame rate and the display resolution.

Field emission display 50 includes a plurality of cathodes and gate extraction electrodes, which define an array of pixels. An exemplary configuration for field emission display 50 has a 640 cathodes 54 and 480 gate extraction electrodes 60. If the frame rate is 60 Hz, the maximum pulse width of a driving pulse is equal to 1/(60 Hz*480), or 34.7 $\mu$s. This value or a lower value may be used for the pulse width of the Nth (highest) gray scale level.

Figure 2:
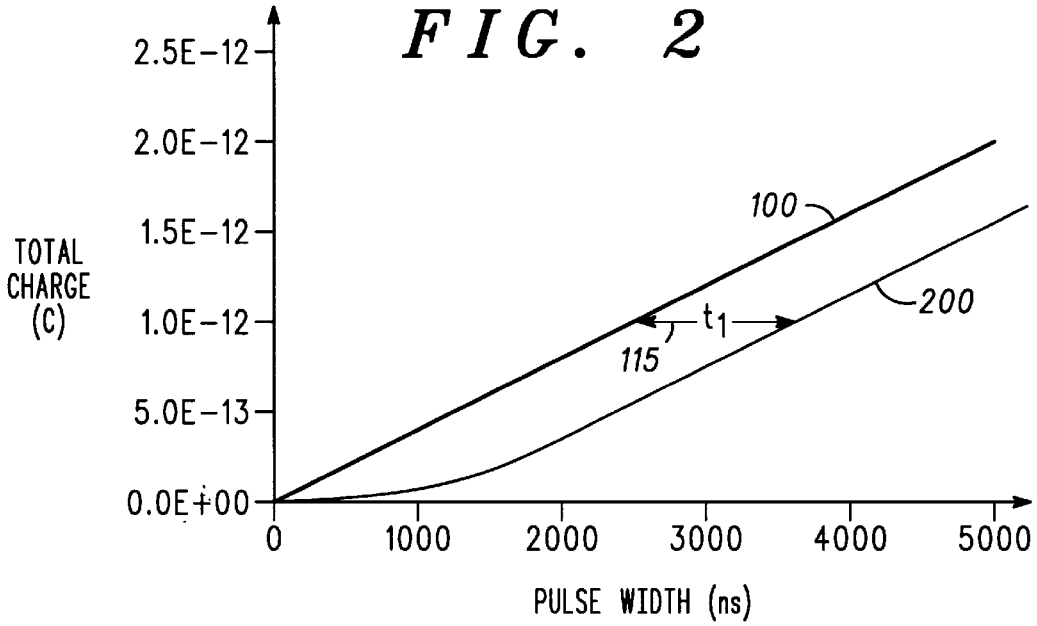
FIG. 2 is a graphical representation of total charge response of a field emission display versus the pulse width of a driving pulse signal applied thereto.

FIG. 2 includes a graphical representation 100 of total charge response versus pulse width of a driving pulse signal for a hypothetical, ideal field emission display having a pixel RC time constant equal to zero nanoseconds. FIG. 2 further includes a graphical representation 200 of total charge response versus pulse width of a driving pulse signal for a non-ideal field emission display, which differs from the display represented by graphical representation 100 only in that it has a ballast that has a sheet resistance of 166 M Ω/sq. The pixel RC time constant of the display represented by graphical representation 200 is about 520 nanoseconds.

A pulse width separation 115 is defined as the horizontal distance between graphical representation 100 and graphical representation 200 at a region wherein the two graphs are generally parallel to one another. Most preferably, pulse width separation 115 is equal to an amount by which graphical representation 200 is shifted to provide a new charge response graph that results in a luminance error of less than or equal to 3% for n>7. Luminance error is described in greater detail with reference to FIGS. 5 and 6. According to the most preferred embodiment of the method of the invention, a pulse width, $t_1$, of the first driving pulse is equal to pulse width separation 115.

In general, as the ballast resistance within the non-ideal display increases, the graph of total charge response versus pulse width of a driving pulse signal deviates further from graphical representation 100. That is, pulse width separation 115 increases and, in accordance with the method of the invention, $t_1$ is also increased.

In accordance with the method of the invention, the first driving pulse has a pulse width that is greater than the pixel RC time constant of the field emission display. Preferably, the pulse width of the first driving pulse is greater than twice the pixel RC time constant of the field emission display.

Figure 3:
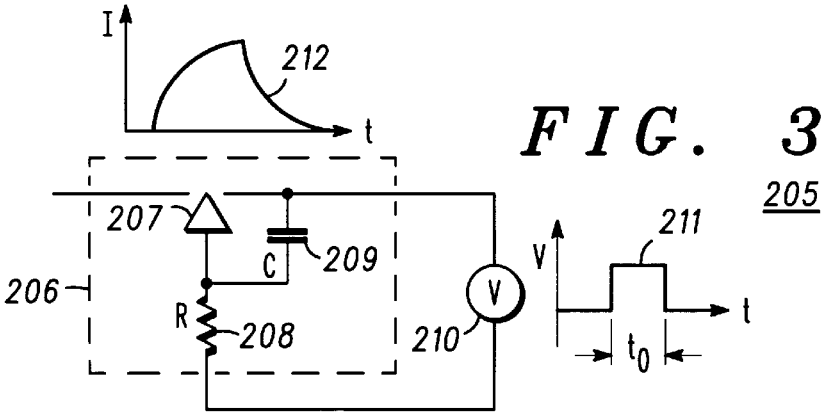
FIG. 3 is a schematic representation of a circuit model useful for calculating the pulse width of the first gray scale level in accordance with the invention.

FIG. 3 is a schematic representation of a circuit model 205 useful for calculating the pulse width of a first driving pulse corresponding to the first gray scale level in accordance with the invention. Specifically, circuit model 205 can be used to generate the total charge response graph of the field emission display with respect to pulse width of a driving pulse.

A pixel 206 of the field emission display is modeled by the portion of circuit model 205 enclosed in a dashed line box. Pixel 206 includes an independent current source 207, which models the electron emitters, a resistive element 208, and a capacitive element 209. A voltage source 210 is used to model the application to pixel 206 of a driving pulse 211 having a pulse width, to.

A circuit simulation computer program can be generated for circuit model 205. The circuit simulation program can be used to generate the total charge response of a field emission display having a particular set of device parameters, such as resistance, R, and capacitance, C. For different values of pulse width, $t_0$, the circuit simulation program is used to calculate a current response 212 at independent current source 207. Then, the total charge of current response 212 is determined by integration. These steps are repeated for as many values of to as are required to generate a charge response curve, such as graphical representation 200 of FIG. 2. The charge response curve thus generated is then used to determine the pulse width of the first driving pulse in the manner described with reference to FIG. 2.

Figure 4:
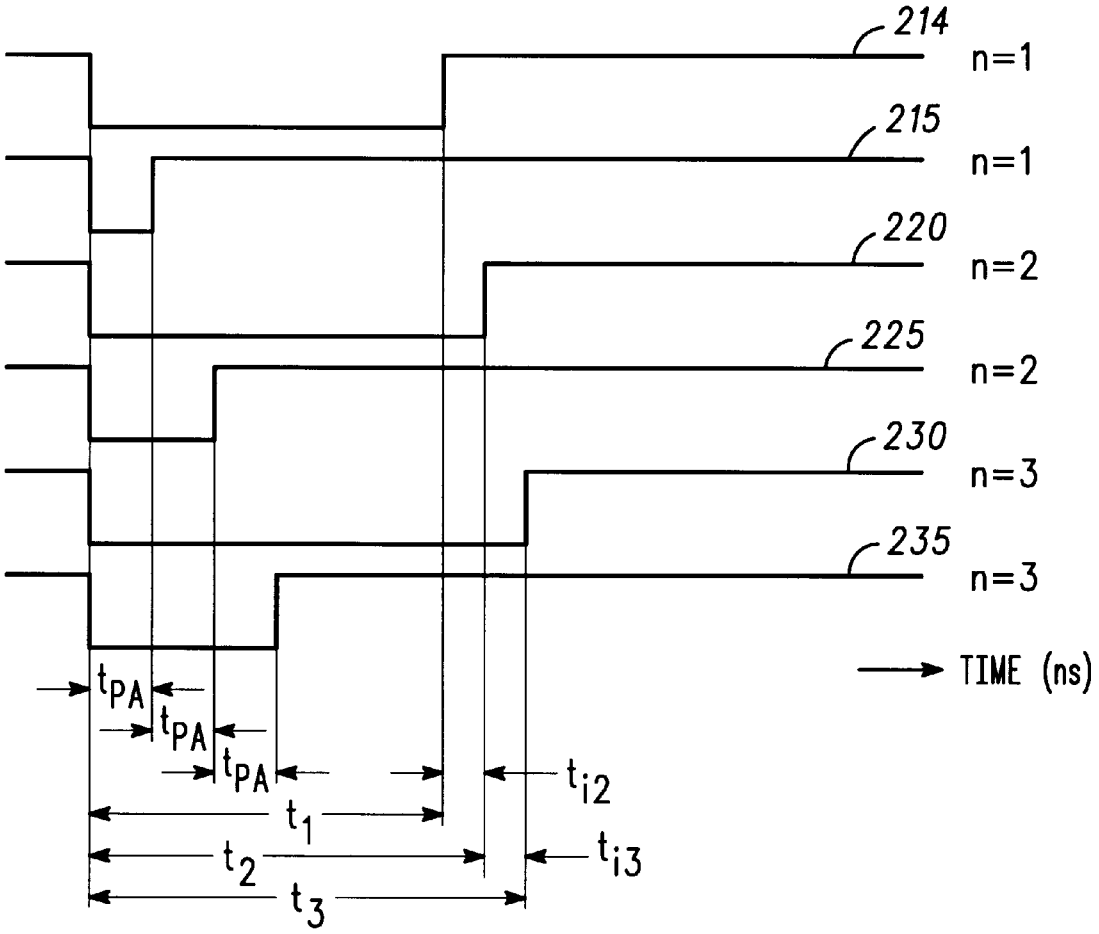
FIG. 4 includes a timing diagram useful for implementing the method of the invention and further includes a prior art timing diagram.

FIG. 4 includes a timing diagram useful for implementing a method for providing a gray scale in a field emission display in accordance with the invention, and further includes a prior art timing diagram for the purposes of comparison. Subsequent to the step of determining pulse width $t_1$ for a first driving pulse 214 corresponding to the first gray scale level (n=1), the pulse widths of the remaining gray scale levels are determined as follows and in accordance with the invention.

As described with reference to FIG. 1, the maximum possible pulse width of a driving pulse for the display is equal to the inverse of the product of the frame rate and the display resolution. The pulse width, $t_N$, of the driving pulse corresponding to the Nth (highest) gray scale level is the longest of all the gray scale levels. The maximum possible value of the pulse width, $t_N$, of the driving pulse corresponding to the Nth gray scale level is equal to the maximum pulse width of a driving pulse for the display.

After selecting the pulse width, $t_N$, for the Nth gray scale level, a pulse width increment, $t_{in}$, for the nth gray scale level is calculated. In one example of the invention, the pulse width increment, $t_{in}$, is the same for all n. In another example, the pulse width increment, $t_{in}$, for selected n is further adjusted to correct for perceived non-linearities in brightness response due to characteristics of the human eye. These corrections are referred to as gamma corrections. To realize the former example of the invention, the pulse width increment, tin, is calculated according to equation (1):

$$t_{in}=(t_N-t_1)/(N-1) \quad (1)$$

The pulse width increment, $t_{in}$, is user to calculate the pulse width, $t_n$, of the nth driving pulse, which corresponds to the nth gray scale level. The pulse width of the nth driving pulse is given by general equation (2):

$$t_n=t_1+\Sigma t_{in} \quad (2)$$

wherein the summation is taken from n=2 to n ($t_{i1}$ is zero). If the pulse width increment, $t_{in}$, is the same for all n>1, equation (2) for the pulse width becomes:

$$t_n=t_1+(n-1)*t_{in}. \quad (3)$$

Thus, as illustrated in the timing diagram of FIG. 4, the pulse width, $t_2$, of a second driving pulse 220 for gray scale level n=2 is equal to ($t_1+t_{i2}$), wherein $t_{i2}$ is the pulse width increment for the second gray scale level. The pulse width, $t_3$ of a third driving pulse 230 for gray scale level n=3 is equal to ($t_1+2*t_{i3}$), wherein $t_{i3}$ is the pulse width increment for the third gray scale level. In this example, the pulse width increments are the same and are given, by $t_{i2}=t_{i3}=(t_N-t_1)/(N-1)$. In the method of the invention, the pulse width increment, $t_{in}$, is less than pulse width 115, $t_1$, of first driving pulse 214 because, in general, the desired number of gray scale levels, N, is greater than the ratio $t_N/t_1$.

Further illustrated in FIG. 4 is a typical prior art scheme for providing gray scale levels. In this prior art method, the pulse width of the driving pulse for the nth gray scale level is equal to $n*t_{PA}$, wherein a prior art pulse width increment, $t_{PA}$, is given by $t_{PA}=t_N/N$. Thus, for example, the pulse width of a prior art first driving pulse 215 is $t_{PA}$; the pulse width of a prior art second driving pulse 225 is $2*t_{PA}$; the pulse width of a prior art third driving pulse 235 is $3*t_{PA}$.

Tabulated in Table I below is an exemplary sequence of pulse widths for a method for providing a gray scale, in accordance with the invention. Also included in Table I is a typical prior art sequence.

TABLE I

Method of the Invention Contrasted with Prior Art Method

| Gray Scale Level | Prior Art Pulse Width (ns) | Method of the Invention Pulse Width (ns) | Method of the Invention Pulse Width Increment (ns) |
|---|---|---|---|
| 1 | 234 | 1158 | 0 |
| 2 | 468 | 1389 | 231 |
| 3 | 702 | 1620 | 231 |
| . | . | . | . |
| . | . | . | . |
| . | . | . | . |
| 255 | 59670 | 59832 | . |
| 256 | 59901 | 60163 | 331 |

The particular values for the pulse widths listed in Table I are useful for the display represented by graphical representation 200 of FIG. 2. As mentioned with reference to FIG. 2, the pixel RC time constant for this display is about 520 nanoseconds. The pulse width of the first driving pulse is desired to be greater than the pixel RC time constant. In this example, pulse width $t_1$ of first driving pulse 214 is 1158 ns, which is equal to about pulse width separation 115, as described with reference to FIG. 2.

The display for use with the example of Table 1 is a _VGA, the line scanning time for which is about 69.4 μs. The maximum pulse width corresponding to the highest gray scale level (N=256) is selected within this line scanning time and, in this instance, is equal to 60.163 μs. Thus, the pulse width increment is equal to (60163 ns−1158 ns)/(256−1), or about 231 ns. This pulse width increment is less than one third of pulse width $t_1$ of first driving pulse 214.

For the example of Table I, the pulse width increments at the lower gray scale levels are the same because the eye response at the lower brightness levels is linear. However, at the highest gray scale levels, the eye response to brightness is not linear. Thus, as shown in Table I, a gamma correction is made to the pulse width increment at n=256, and the value of the pulse width increment at n=256 is 331 ns.

The prior art sequence tabulated in Table I is also for a _VGA display. The maximum pulse width corresponding to N=256 is predetermined to be 59901 ns. Thus, the prior art pulse width increment is equal to 59901/256 ns, or about 234 ns. Because the pulse width of prior art first driving pulse 215 and the prior art pulse width increment are each less than the pixel RC time constant (520 ns) of the display, the first few lower gray scale levels are distorted. This distortion is illustrated in FIG. 5.

FIG. 5 includes a graphical representation 400 of luminance, L, versus gray scale level, n, for the field emission display represented by graphical representation 200 of FIG. 2 when the display is driven using the method of the invention. FIG. 5 further includes a graphical representation 410 of luminance versus gray scale level for the same field emission display when the display is driven in accordance with the method of the prior art as described with reference to FIG. 4. FIG. 5 also includes a graphical representation 420 of luminance versus gray scale level for the ideal field emission display represented by graphical representation 100 of FIG. 2 when the ideal display is driven in accordance with the method of the prior art as described with reference to FIG. 4.

FIG. 6 presents the information of FIG. 5 in terms of luminance error, $E_L$, versus gray scale level, n. FIG. 6 includes a graphical representation 300 of the luminance error for the non-ideal display being driven by the method of the invention. FIG. 6 further includes a graphical representation 320 of the luminance error for the non-ideal display being driven by the prior art method.

Luminance error, $E_L$, for a specified n is given by equation (4):

$$E_L=[(L_{0n}-L_n)/L_{0n}]\cdot 100\%, \quad (4)$$

wherein $L_{0n}$ is the luminance of the zero-resistance, ideal display at gray scale level n (from graph 420 of FIG. 5), and $L_n$ is the luminance of the non-ideal display at gray scale level n (from graph 400 of FIG. 5 to generate graph 300 of FIG. 6; from graph 410 of FIG. 5 to generate graph 320 of FIG. 6).

FIGS. 5 and 6 illustrate that the method of the invention provides a gray scale that substantially reduces luminance error over most of the gray scale levels. The prior art method has the adverse effect of decreasing the luminance by at least 20% for gray scale levels below n=20. In contrast, the method of the invention has a luminance error that is less than 3% for n>7. The luminance error for n<7 is expected to be irrelevant because these luminance values are not discernible by the human eye under normal operating conditions, such as office conditions.

In summary, the method of the invention provides a gray scale for a field emission display that substantially reduces luminance error over most of the gray scales levels. The method of the invention further allows a greater total number, N, of gray scale levels over prior art methods.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

We claim:

1. A method for providing a gray scale in a field emission display having a pixel RC time constant, the method comprising the steps of:

providing a first driving pulse corresponding to a first gray scale level, the first driving pulse having a pulse width that is greater than the pixel RC time constant of the field emission display; and providing a second driving pulse corresponding to a second gray scale level, the second driving pulse having a pulse width equal to the sum of the pulse width of the first driving pulse and a pulse width increment, the pulse width increment being less than the pulse width of the first driving pulse.

2. The method for providing a gray scale in a field emission display as claimed in claim 1, wherein the pulse width of the first driving pulse is greater than twice the pixel RC time constant of the field emission display.

3. The method for providing a gray scale in a field emission display as claimed in claim 1, wherein the pulse width increment is less than half the pulse width of the first driving pulse.

4. The method for providing a gray scale in a field emission display as claimed in claim 3, wherein the pulse width increment is less than one third of the pulse width of the first driving pulse.

5. A method for providing a gray scale having N total number of gray scale levels in a field emission display comprising the steps of:

providing an Nth driving pulse corresponding to an Nth gray scale level and having a pulse width;

providing a first driving pulse corresponding to a first gray scale level and having a pulse width; and providing an nth driving pulse corresponding to an nth gray scale level and having a pulse width, n being an integer within a range of 1–N, the pulse width, $t_n$, of the nth driving pulse being given by $t_n=t_1+[n-1]*t_{in}$ wherein $t_1$ is the pulse width of the first driving pulse and $t_{in}$ is a pulse width increment that is less than the pulse width of the first driving pulse.

6. The method for providing a gray scale in a field emission display as claimed in claim 5, wherein N is greater than 100.

7. The method for providing a gray scale in a field emission display as claimed in claim 6, wherein N is greater than 200.

8. The method for providing a gray scale in a field emission display as claimed in claim 7, wherein N is equal to 256.

9. The method for providing a gray scale in a field emission display as claimed in claim 5, wherein the pulse width of the first driving pulse corresponding to the first gray scale level is greater than 500 nanoseconds.

10. The method for providing a gray scale in a field emission display as claimed in claim 9, wherein the pulse width of the first driving pulse corresponding to the first gray scale level is greater than 1000 nanoseconds.

11. The method for providing a gray scale in a field emission display as claimed in claim 5, wherein the pulse width of the first driving pulse is equal to about a pulse width separation between a pair of graphs of total charge response versus pulse width of a driving pulse for the field emission display and for a corresponding ideal field emission display, the pulse width separation being derived from a portion of the pair of graphs wherein the pair of graphs are generally parallel to one another.

12. The method for providing a gray scale in a field emission display as claimed in claim 5, wherein the pulse width increment is given by $t_{in}=(t_N-t_1)/(N-1)$ wherein $t_1$ is the pulse width of the first driving pulse, N is the total number of gray scale levels, and $t_N$ is the pulse width of the Nth driving pulse.

13. The method for providing a gray scale in a field emission display as claimed in claim 12, wherein the step of providing a first driving pulse includes the step of providing a first driving pulse having a pulse width selected to provide a luminance error of less than or equal to 3% for gray scale levels greater than 7.

14. A method for providing a gray scale having N gray scale levels in a field emission display having a pixel RC time constant, the method comprising the steps of:

providing an Nth driving pulse corresponding to an Nth gray scale level and having a pulse width;

providing a first driving pulse corresponding to a first gray scale level, the first driving pulse having a pulse width that is greater than the pixel RC time constant of the field emission display; and providing an nth driving pulse corresponding to an nth gray scale level and having a pulse width, n being an integer within a range of 1–N, the pulse width, $t_n$, of the nth driving pulse being given by $t_n=t_1+[n-1]*t_{in}$ wherein $t_1$ is the pulse width of the first driving pulse and $t_{in}$ is a pulse width increment that is less than the pulse width of the first driving pulse.

15. A method for providing a gray scale in a field emission display comprising the steps of:

providing a first graph representing total charge response versus pulse width of a driving pulse for the field emission display;

providing a second graph representing total charge response versus pulse width of a driving pulse for a corresponding ideal field emission display that has a zero RC time constant, the first graph having a pulse width separation from the second graph at a portion wherein the first and second graphs are generally parallel to one another; and driving the field emission display with an nth driving pulse corresponding to an nth gray scale level and having a pulse width given by the equation $t_n=t_1+\Sigma t_{in}$ wherein $t_n$ is the pulse width of the nth driving pulse, $t_1$ is the pulse width separation between the first and second graphs, and $t_{in}$ is a pulse width increment for the nth gray scale level.

16. The method for providing a gray scale in a field emission display as claimed in claim 15, wherein the pulse width, $t_n$, of the nth driving pulse is given by the equation $t_n=t_1+[n-1]*[(t_N-t_1)/(N-1)]$ wherein $t_n$ is the pulse width of the nth driving pulse, $t_1$ is the pulse width separation between the first and second graphs, N is a total number of gray scale levels, and $t_N$ is a pulse width of an Nth driving pulse corresponding to the Nth gray scale level.

* * * * *